US005890933A

United States Patent [19]

Okabe

[11] Patent Number: 5,890,933

[45] Date of Patent: Apr. 6, 1999

[54] COMBINED-TYPE CONNECTOR

[75] Inventor: Toshiaki Okabe, Shizuoka, Japan

[73] Assignee: Yazaki Corporation, Tokyo, Japan

[21] Appl. No.: 933,965

[22] Filed: Sep. 19, 1997

[30] Foreign Application Priority Data

Sep. 20, 1996 [JP] Japan ..... 8-250295

[51] Int. Cl.[6] ..... H01R 13/502

[52] U.S. Cl. ..... 439/701; 439/718

[58] Field of Search ..... 439/594, 595, 439/599, 701, 717, 718, 752

[56] References Cited

U.S. PATENT DOCUMENTS

| | | | |
|---|---|---|---|
| 5,201,674 | 4/1993 | Okura | 439/595 |
| 5,286,225 | 2/1994 | Tsuji | 439/717 X |
| 5,551,896 | 9/1996 | Hess et al. | 439/701 |

FOREIGN PATENT DOCUMENTS

| | | | |
|---|---|---|---|
| 5-53153 | 7/1993 | Japan | H01R 13/514 |

*Primary Examiner*—Khiem Nguyen
*Attorney, Agent, or Firm*—Sughrue, Mion, Zinn, Macpeak & Seas, PLLC

[57] ABSTRACT

In a combined-type connector, a plurality of connector housings are stacked one upon another and connected together. Engagement projections are formed on one of the adjacent connector housings while engagement recesses for engagement respectively with the engagement projections are formed in the other connector housing. A wedge-shaped portion is formed at at least one of the engagement projection and the engagement recess. When a pulling force acts on the connector housing through wires extending therefrom, the wedge-shaped portion produces a force to strengthen the engagement of the engagement projection with the engagement recess, thereby preventing the engagement projection from being disengaged from the engagement recess.

4 Claims, 6 Drawing Sheets

COMBINED-TYPE CONNECTOR

BACKGROUND OF THE INVENTION

This invention relates to a combined-type connector comprising a plurality of connector housings stacked one upon another and connected together.

FIG. 5 is a perspective view of a combined-type connector in a condition before a combined condition, which connector is disclosed in Japanese Utility Model Unexamined Publication No. Hei. 5-53153, and FIG. 6 is a cross-sectional view of a main portion thereof. This combined-type connector comprises a plurality of generally box-shaped connector housings 1 stacked one upon another and connected together, each of the connector housings having upper and lower flat walls. Downwardly-extending engagement hooks 2 are formed respectively at lower edges of right and left side walls of each connector housing 1, and engagement portions 3 for retaining engagement with the associated engagement hooks 2 are formed respectively in outer surfaces of these right and left side walls by notching. The connector housings 1, each having wires W extending rearwardly therefrom, are stacked one upon another, and in this condition the engagement hooks 2 of the upper one of any two adjacent connector housings 1 are retainingly engaged respectively in the engagement portions 3 of the lower connector housing 1, so that the adjacent connector housings 1 are fixedly combined together, thereby forming the combined-type connector.

When this combined-type connector is installed in a body of an automobile so as to connect a wire harness, a pulling force sometimes acts on the connector housings 1 through the wires W, extending rearwardly from the connector housings 1, in a direction of arrow A as shown in FIG. 7(*a*). At this time, if the lower housing 1 is caught by a nearby projected portion 10, there is exerted a force which causes the upper connector housings 1 to be pivotally moved relative to the lower connector housing 1 about a region P of engagement between the engagement hook 2 and the engagement portion 3, so that the lower housing 1 is disconnected from the upper housings 1 as shown in FIG. 7(*b*), and this prevents the connection of the wire harness to the vehicle body.

SUMMARY OF THE INVENTION

With the above problem in view, it is an object of this invention to provide a combined-type connector in which connector housings, once connected together, will not be easily disconnected from each other.

According to a first aspect of the invention, there is provided a combined-type connector wherein a plurality of connector housings are stacked one upon another and connected together; CHARACTERIZED in that engagement projections are formed on one of the adjacent connector housings while engagement recesses for engagement respectively with the engagement projections are formed in the other connector housing; and a wedge-shaped portion is formed at at least one of the engagement projection and the engagement recess, so that when a pulling force acts on the connector housing through wires extending therefrom, the wedge-shaped portion produces a force to strengthen the engagement of the engagement projection with the engagement recess, thereby preventing the engagement projection from being disengaged from the engagement recess.

In this combined-type connector, when a pulling force acts on the connector housing through the wires, the force of engagement between the engagement projection and the engagement recess is strengthened, thereby preventing the two connector housings from being disengaged from each other.

According to a second aspect of the invention, in the combined-type connector of the first aspect, end surfaces of the engagement projection and the engagement recess, which are pressed against each other when the pulling force is exerted, are oblique to thereby provide the wedge-shaped portion.

In this combined-type connector, when the pulling force is exerted, the oblique surfaces are pressed against each other, so that the engagement force is increased by the wedging effect.

According to a third aspect of the invention, in the combined-type connector of the second aspect, there is provided connecting means for connecting the connector housings together, and the engagement projections and the engagement recesses are positioning means.

In this combined-type connector, usually, the connector housings are connected together by the connecting means so that they will not be disengaged from each other, and the positioning of the connector housings is effected by the engagement projections and the engagement recesses. When the pulling force is exerted through the wires, the force of engagement between the engagement projection and the engagement recess is strengthened, thereby preventing the connector housings from being disengaged from each other.

According to a fourth aspect of the invention, in the combined-type connector of the third aspect, the engagement projections, as well as the engagement recesses, are formed respectively at right and left side walls of the connector housing, and the end surfaces of the engagement projection and the engagement recess in a forward-rearward direction, which limit the positions of the connector housings in the forward-rearward direction when the connector housings are stacked together, are oblique to thereby form the wedge-shaped portion.

In this combined-type connector, the positions of the upper and lower connector housings in the forward-rearward direction are limited by the engagement of the engagement projection with the engagement recess. At this time, the end surfaces of the engagement projection and the engagement recess in the forward-reward direction, function as limiting surfaces, and when the pulling force is exerted, the oblique end surfaces are pressed against each other, so that the engagement force is increased by the wedging effect.

DETAILED DESCRIPTION OF THE INVENTION

A preferred embodiment of the present invention will now be described with reference to the drawings.

Figure 1A:
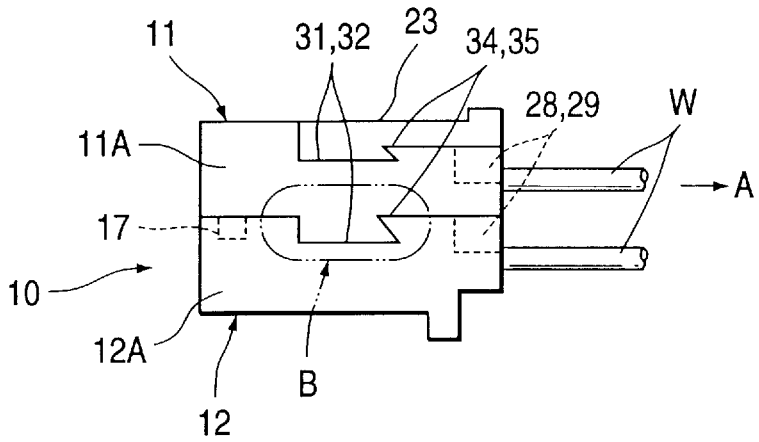
FIGS. 1(*a*) and 1(*b*) are schematic views showing the construction of a preferred embodiment of the invention, FIG. 1(*a*) being a side-elevational view thereof, and FIG. 1(*b*) being an enlarged view of a portion B of FIG. 1(*a*)
Figure 1B:
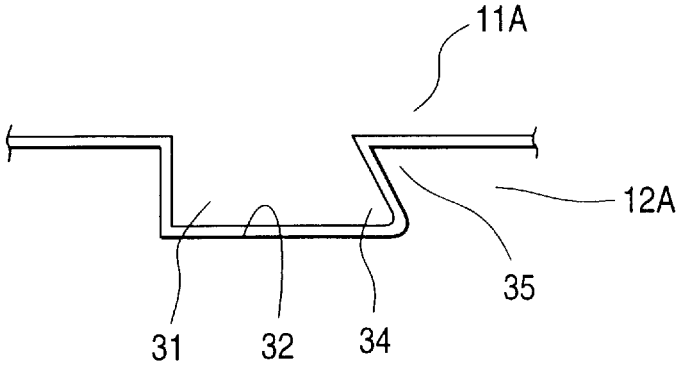

FIG. 1(*a*) is a schematic view showing the construction of a combined-type connector 10 of this embodiment in its combined condition, and FIG. 1(*b*) is an enlarged view of an engagement region B. This combined-type connector 10 comprises a lower connector 12, an upper connector 11 stacked on and connected to the lower connector 12, and an upper cover 23 connected to the upper connector 11.

Figure 2:
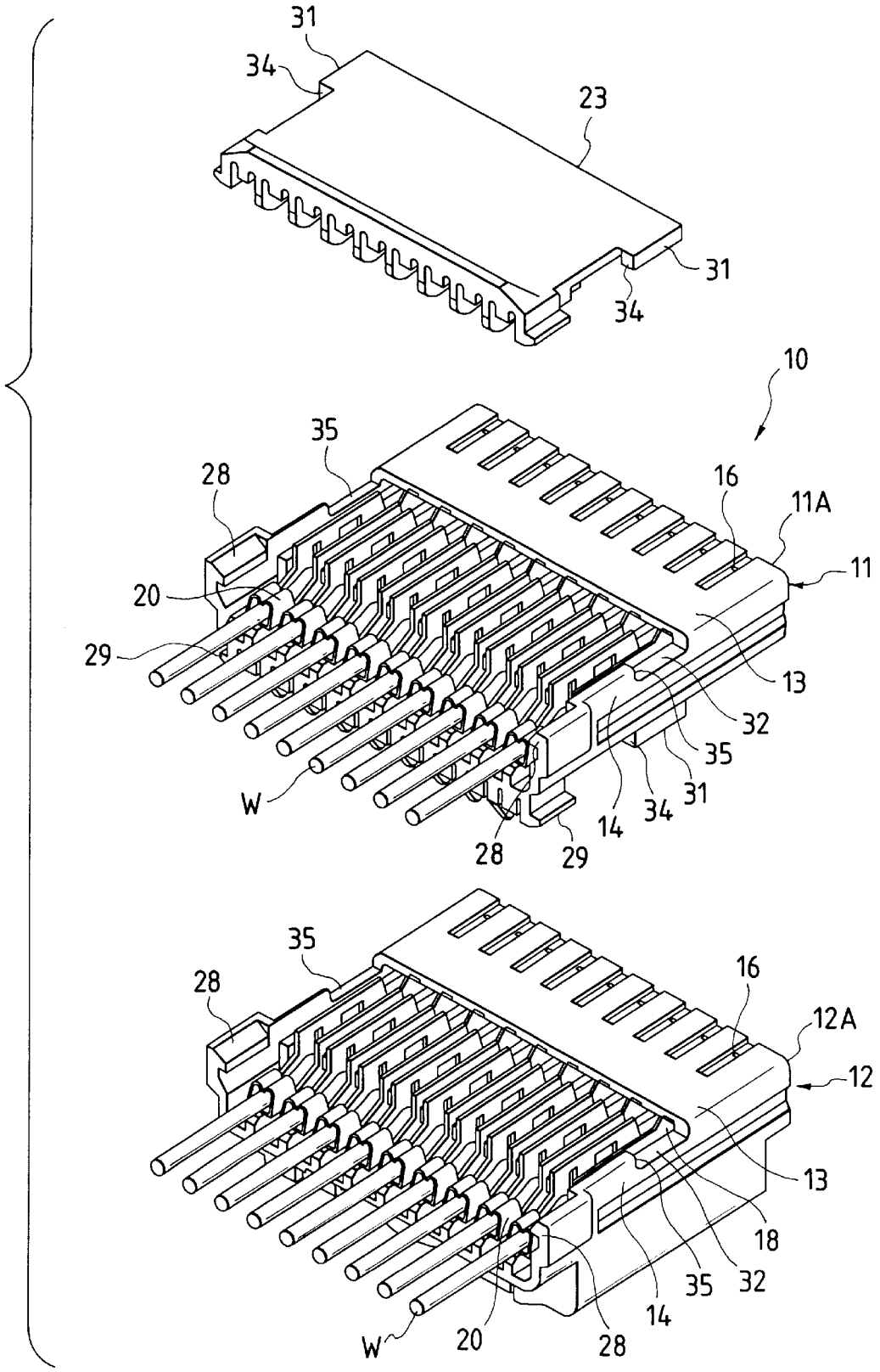
FIG. 2 is an exploded, perspective view of the embodiment of the invention.
Figure 3:
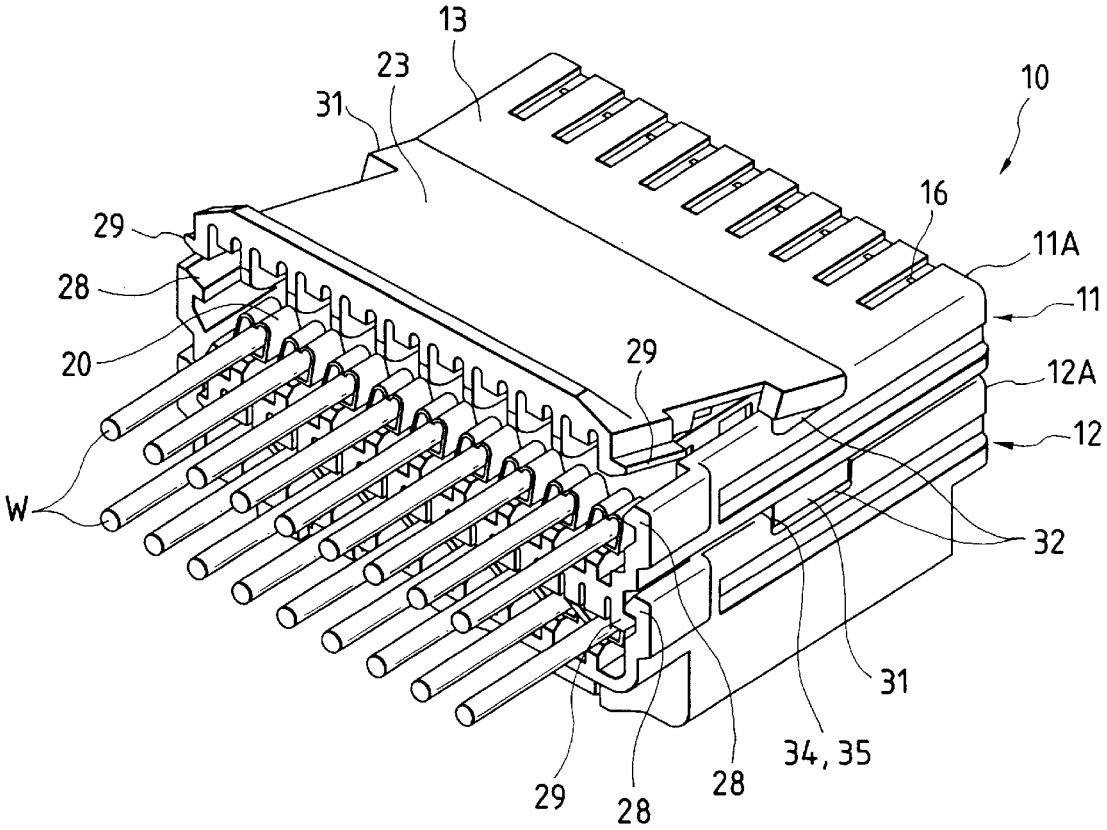
FIG. 3 is a perspective view showing a condition during the assembling of the embodiment of the invention.
Figure 4:
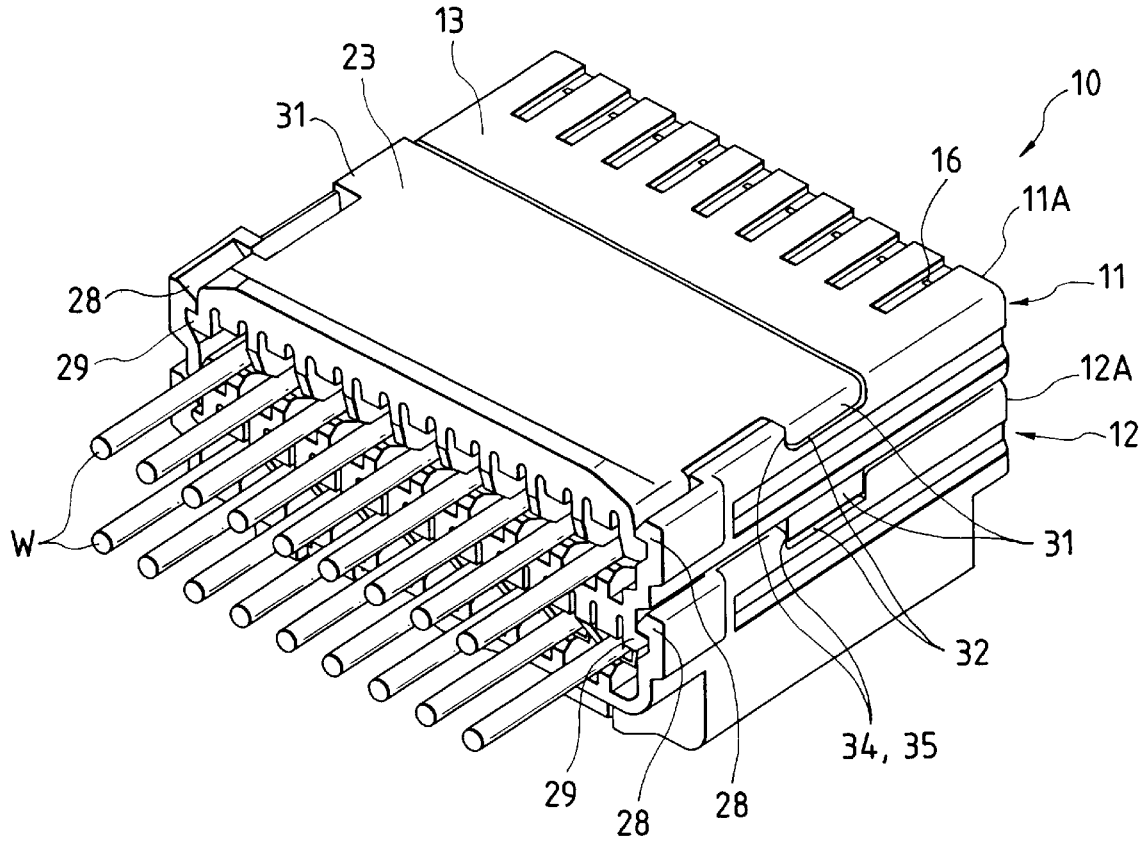
FIG. 4 is a perspective view showing the embodiment of the invention in its assembled condition.
Figure 5:
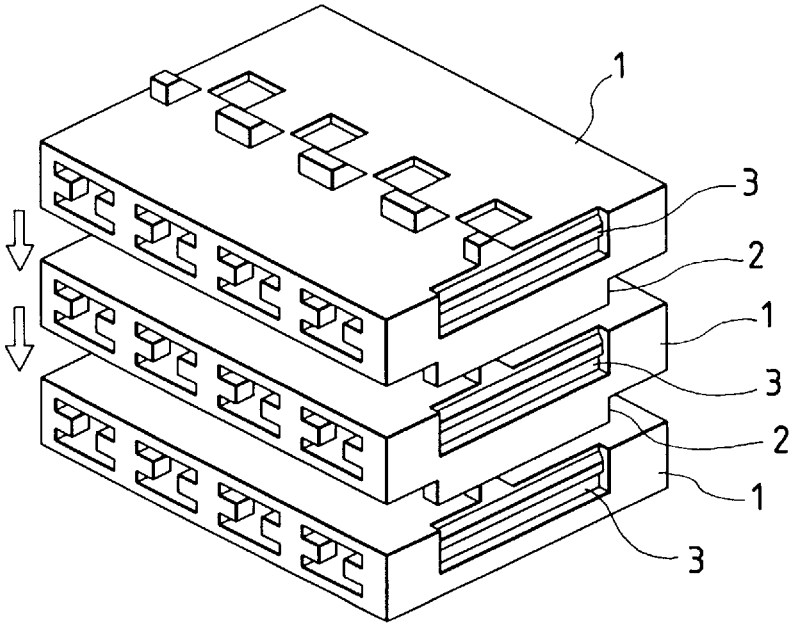
FIG. 5 PRIOR ART
FIG. 5 is a perspective view of a conventional combined-type connector in a condition before a combined condition.
Figure 6:
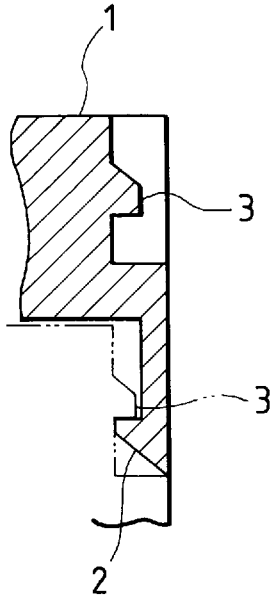
FIG. 6 PRIOR ART
FIG. 6 is a cross-sectional view of a main portion of the combined-type connector of FIG. 5.
Figure 7A:
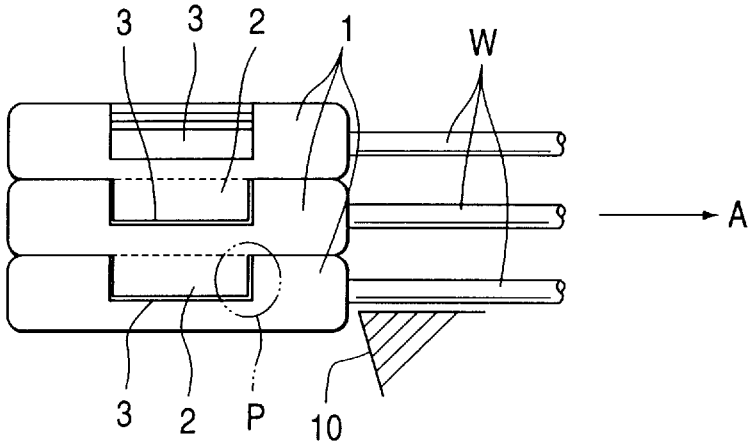
FIG. 7(a) PRIOR ART
FIGS. 7(*a*) and 7(*b*) are views explanatory of a problem with the combined-type connector of FIG. 5, FIG. 7(*a*) being a side-elevational view showing a condition before an upper connector housing is disengaged from a lower connector housing, and FIG. 7(*b*) being a side-elevational view showing a condition after this disengagement occurs.
Figure 7B:
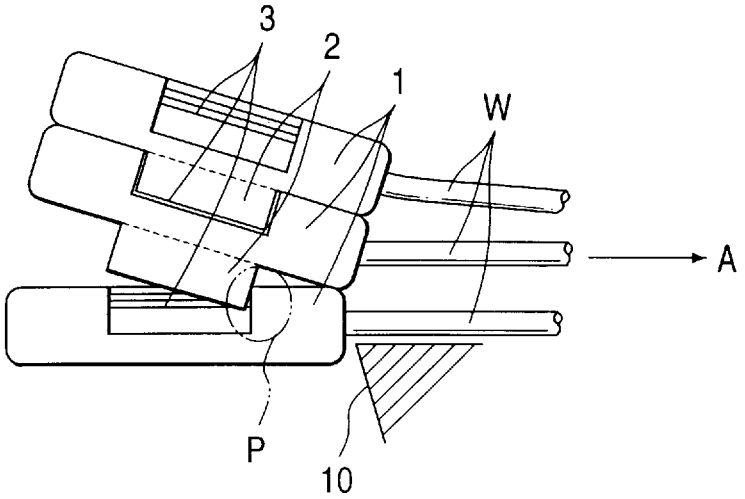
FIG. 7(b) PRIOR ART

FIG. 2 is a perspective view showing the combined-type connector 10 of this embodiment in a condition before the combined condition, FIG. 3 is a perspective view showing a condition during the assembling operation, and FIG. 4 is a perspective view showing a condition after the assembling operation is completed. The upper connector 11 and the lower connector 12 have substantially the same construction and size, and the upper connector 11 will be first described.

As shown in FIG. 2, a housing 11A of the upper connector 11 has a generally box-shape, and includes an upper flat wall 13, a lower flat wall (not shown), and right and left side walls 14, and this housing 11A has a plurality of terminal receiving chambers 18 formed therein, these chambers 18 being juxtaposed in a right-left direction. The upper wall 13 is provided only at a front half portion of this connector housing, and a rear half portion thereof is open upwardly. This upwardly-open portion is provided so as to facilitate the press-connecting of wires to terminals 20 received respectively in the terminal receiving chambers 18, and this upwardly-open portion is closed by another housing 11 or the upper cover 23 placed on the upper side of the housing 11A.

A front end of each of the terminal receiving chambers 18 is formed into a mating terminal-inserting holes (not shown) open to the exterior, and a rear end of the terminal receiving chamber is open so that the wire W can extend through this open rear end. Lance holes 16 are formed through the upper wall 13 of the connector housing 11A, and are disposed correspondingly to front end portions of the terminal receiving chambers 18, respectively. The lance hole 16 retains the terminal 20 inserted into the terminal receiving chamber 18 from a rear side thereof, and extends from the outer surface to the terminal receiving chamber 18.

Similarly, terminal receiving chambers 18, mating terminal-inserting holes and lance holes 16 are formed in the lower connector 12.

Connecting hooks 17 (schematically shown in FIG. 1(*a*)) are formed on and project from the lower wall of the housing 11A of the upper connector 11, and these connecting hooks 17 are retainingly engaged respectively in the lance holes 16 formed in an upper wall 13 of a housing 12A of the lower connector 12. The connecting hooks 17 correspond respectively to the lance holes 16 (but the connecting hooks may correspond respectively to part of the lance holes 16). Any connecting hook is not formed on the housing 12A of the lower housing 12 since any connector is not connected to the lower side of the lower connector 12.

Inwardly-directed hooks 28 are formed respectively at upper portions of right and left sides of the rear end portion of the connector housing 11A, and outwardly-directed hooks 29 are formed respectively at lower portions of the right and left sides of the rear end portion of the connector housing 11A. When the connector housings are stacked together, the inwardly-directed hooks 28 are engaged respectively with the associated outwardly-directed hooks 29. Any outwardly-directed hook is not formed at the lower portion of the rear end portion of the housing 12A of the lower housing 12 since any connector housing is not connected to the lower side of the lower connector 12. The outwardly-directed hooks 29 are formed respectively at lower portions of right and left sides of a rear end portion of the upper cover 23.

In this embodiment, the connection hooks 17 (see FIG. 1(*a*)), formed at the front end portion for retaining engagement in the associated lance holes 16, and the hooks 28 and 29, formed at the rear end portion, jointly constitute connecting means for connecting the upper and lower connector housings 11A and 12A together in the upward-downward direction.

An engagement projection 31 is formed at a lower edge of each of the right and left side walls 14 of the upper connector housing 11A, and is disposed at an intermediate portion in the front and rear direction of this housing. An engagement recess 32 for fitting on the associated engagement projection 31 is formed in an upper edge of each of these right and left side walls 14, and is disposed at an intermediate portion in the front and rear direction of the housing. With respect to the lower connector housing 12A, only engagement recesses 32 are formed in the upper side thereof. With respect to the upper cover 23, only engagement projections 31 are formed thereon.

The engagement projections 31 and the engagement recesses 32 serve as positioning means for positioning the connector housings 11A and 12A with respect to each other in the forward-rearward direction, and front and rear edges (surfaces) of the projections 31 and recesses 32 serve as position-limiting surfaces. The rear end surfaces of the engagement projection 31 and the engagement recess 32 are defined respectively by oblique surfaces which are pressed against each other when a pulling force A acts on the upper connector housing 11A through the wires W extending rearwardly therefrom as shown in FIG. 1, and thus wedge-shaped portions 34 and 35 are formed respectively at the rear ends of the engagement projection 31 and the engagement recess 32.

When the above pulling force A is produced, these wedge-shaped portions 34 and 35 are engaged with each other to produce a force to strengthen the engagement of the engagement projection 31 with the engagement recess 32, thereby preventing the engagement projection 31 from being disengaged from the engagement recess 32.

For assembling the combined-type connector 10 of this embodiment, the terminals 20 are mounted in the two connector housings 11A and 12A, and then the wires W are press-connected respectively to the terminals 20, as shown in FIG. 2. Then, the upper connector 11 is placed on the upper surface of the lower connector 12, and the connecting hooks (see FIG. 1(*a*)) on the lower surface of the upper connector 11 are inserted and retained in the associated lance holes 16 in the lower connector 12, as shown in FIG. 3. At the same time, the outwardly-directed hooks 29, formed at the rear end portion of the connector 11, are engaged respectively with the inwardly-directed hooks 28, formed at the rear end portion of the lower connector 12, and also the engagement projections 31 are engaged respectively with the engagement recesses 32, thereby positioning the connectors 11 and 12 with respect to each other in the forward-rearward direction. Finally, the outwardly-directed hooks 29, formed on the rear end portion of the upper cover 23, are engaged respectively with the inwardly-directed hooks 28 on the upper connector 11, thereby completing the assembling of the combined-type connector 10 of this embodiment, as shown in FIG. 4.

In this combined-type connector 10, when the pulling force A acts on the upper connector 11 through the wires W as shown in FIG. 1(*a*), the wedge-shaped portions 34 of the engagement projections 31 are more firmly engaged respectively with the wedge-shaped portions 35 of the engagement recesses 32, and therefore the engagement force is increased, thereby preventing the upper and lower connectors 11 and 12 from being disengaged from each other.

In the above embodiment, although the number of the connecting stages is two, it is not limited to two, but may be three or more in which case the additional connector or connectors are stacked on the upper connector 11.

In the above embodiment, the wedge-shaped portions 34 and 35 are formed respectively at the engagement projection 31 and the engagement recess 32. However, if the wedging effect can be achieved when the above pulling force is exerted, the wedge-shaped portion may be formed on one of the engagement projection 31 and the engagement recess 32.

In the above embodiment, the engagement projections 31 and the engagement recesses 32 are provided mainly as the positioning means. However, if the upper and lower connectors 11 and 12 can be connected together only by the connecting force produced by the engagement projections 31 and the engagement recesses 32, it is not always necessary to provide the connecting hooks 17 and the other hooks 28 and 29 for connecting purposes.

As described above, according to the first aspect of the invention, when the pulling force acts on the connector housing through the wires, the force of engagement between the engagement projection and the engagement recess is increased, thereby preventing the connector housings from being disengaged from each other. Therefore, the connector housings, connected together, are less liable to be disconnected from each other, so that the installation of a wire harness can be carried out without trouble.

According to the second aspect of the invention, merely by inclining the end surfaces of the engagement projection and the engagement recess, the effect of the first aspect can be achieved.

According to the third aspect of the invention, in addition to the effect of the second aspect, the following effect is achieved. There is provided the connecting means, and therefore the engagement projection and the engagement recess can be used as extra connecting means which performs its function when the pulling force is exerted through the wires.

According to the fourth aspect of the invention, in addition to the effect of the third aspect, the following effect is achieved. The end surfaces of the engagement projection and the engagement recess, which position the connector housings in the forward-rearward direction, are oblique, and with this simple construction the engagement projection and the engagement recess can be used as extra connecting means which performs its function when the pulling force is exerted through the wires.

What is claimed is:

1. A combined-type connector in which a plurality of connector housings are stacked one upon another and connected together; said combined-typed connector comprising:

an engagement projection disposed on one of the adjacent connector housings;

an engagement recess disposed in the other of the adjacent connector housings and for engagement with said engagement projection; and a wedge-shaped portion disposed at said engagement projection and said engagement recess, said wedge-shaped portion producing a force to strengthen engagement of said engagement projection with said engagement recess when a pulling force acts on said connector housing through wires extending from said connector housing, thereby preventing said engagement projection from being disengaged from said engagement recess, wherein said wedge-shaped portions are formed on said engagement projection and said engagement recess to be angled toward a direction of the pulling force acting on said connector housing so as to counter the pulling force and prevent said engagement projection from being disengaged from said engagement recess.

2. A combined-type connector according to claim 1, wherein said wedge-shaped portion is an oblique end surface of said engagement projection and said engagement recess, the end surfaces of said engagement projection and said engagement recess being pressed against each other when said pulling force is exerted.

3. A combined-type connector according to claim 2, further comprising connecting means for connecting said connector housings together, said engagement projection and said engagement recess constituting positioning means.

4. A combined-type connector according to claim 3, wherein said engagement projection and said engagement recess are formed at right and left side walls of said connector housing, and said wedge-shaped portion is said oblique end surface of said engagement projection and said engagement recess in a forward-rearward direction of said connector housings, said engagement projection and said engagement recess restricting positions of said connector housings in the forward-rearward direction when said connector housings are stacked together.

* * * * *